United States Patent [19]

Charles

[11] 4,274,878

[45] Jun. 23, 1981

[54] SULPHIDE PELLET MATERIALS

[75] Inventor: James A. Charles, Stapleford, England

[73] Assignees: Metallurgical Processes Limited; I.S.C. Smelting, both of The Bahamas

[21] Appl. No.: 148,958

[22] Filed: May 12, 1980

Related U.S. Application Data

[62] Division of Ser. No. 54,872, Jul. 5, 1979, Pat. No. 4,231,791.

[30] Foreign Application Priority Data

Jul. 5, 1978 [GB] United Kingdom ..... 28729/78

[51] Int. Cl.[3] ..... B22F 1/02

[52] U.S. Cl. ..... 75/256; 75/3; 75/7; 428/403

[58] Field of Search ..... 428/407, 403, 404, 645; 75/3, 7, 26, 77, 0.5 A, 256, 230

[56] References Cited

U.S. PATENT DOCUMENTS

| | | | |
|---|---|---|---|
| 3,060,134 | 10/1962 | Elder et al. | 428/403 X |
| 3,169,852 | 2/1965 | Price | 428/403 X |
| 3,716,403 | 2/1973 | Braun | 428/403 X |
| 3,975,182 | 8/1976 | Goetzman | 428/403 X |
| 4,076,523 | 2/1978 | Yuki | 75/77 |
| 4,105,457 | 8/1978 | Pietsch et al. | 75/256 X |
| 4,207,377 | 6/1980 | Kindrick | 428/404 |

*Primary Examiner*—G. Ozaki

*Attorney, Agent, or Firm*—Holman & Stern

[57] ABSTRACT

A substantially spherical pellet composed predominantly of lead sulphide which is coated with predominantly zinc sulphide material. The lead sulphide core is from 2–6 mm in diameter and the zinc sulphide coating has a thickness of from 1–3 mm. The weight ratio of zinc sulphide to lead sulphide is from 1.5:1 to 2.5:1.

3 Claims, No Drawings

SULPHIDE PELLET MATERIALS

This is a divisional of application Ser. No. 54,872, filed July 5, 1979, now Pat. No. 4,231,791.

BACKGROUND OF THE INVENTION

This invention relates to the roasting of sulphide materials, that is sulphide ores or concentrates, and more particularly to the roasting of zinc/lead sulphide materials which contain more than about 5% by weight of lead sulphide to form sulphide pellets.

The normal practice, when roasting mixed zinc and lead sulphide concentration prior to smelting in a zinc/-lead blast furnace, is to sinter these on a Dwight-Lloyd sinter machine with upflow of air to support combustion of the sulphides. Using this technique concentrates containing up to about 25% by weight of lead sulphide can be handled.

There is, however, a need to develop a roasting process for mixed zinc/lead sulphide concentrates which is independent of this sintering technique. It is known that if such materials can be calcined to particulate oxidic form then they can be densified into briquettes, suitable for feeding to a blast furnace, e.g. by the techniques described in our British Patent Specification Nos. 1,302,864 and 1,394,609.

In the electrolytic winning of zinc it has become standard practice to roast zinc sulphide concentrates in a fluidized bed roaster (see for example the process described in British Patent Specification No. 715,167). The fluidized bed roasting process has the advantages of virtually complete sulphur elimination from the solids, relatively easy heat recovery from the gas, and good gas/solid mixing in the bed. However, the fluidized bed roasting technique will not operate satisfactorily when the solid feed to the fluidized bed contains more than about 5% by weight of lead sulphide. This is because the solids become increasingly sticky with increasing lead content, leading to agglomeration of the solids and a breakdown of fluidization. The molten phase leading to this stickiness in the bed is believed to be composed of a lead oxide/lead sulphate phase which is molten above about 750° C.

SUMMARY OF THE INVENTION

We have now discovered that it is possible to roast, other than by sintering, zinc/lead sulphide materials containing appreciably more than 5% by weight of lead sulphide to produce a product suitable for briquetting.

The process for roasting zinc/lead sulphidic materials, comprises forming substantially spherical pellets composed predominantly of lead sulphide, coating the pellets with predominantly zinc sulphide material, and then roasting the coated pellets in a roasting apparatus to effect oxidation of sulphide, predominantly to oxide.

Preferably the roasting apparatus is a fluidized bed roaster fed with free-oxygen-containing gas, more preferably air.

The roasting is preferably carried out at a temperature of from 850° to 1000° C. However, temperatures up to 1100° C. may be used.

The weight ratio of zinc/sulphide to lead sulphide in the composite pellets may be suitably from 1.5:1 to 2.5:1.

The composite pellets are preferably formed so that the predominantly lead sulphide core is from 2 to 6 mm.

in diameter and the predominantly zinc sulphide shell has a thickness of from 1 to 3 mm.

The materials used to form the cores and coatings are preferably lead sulphide concentrates and zinc sulphide concentrates respectively.

The advantages of the invention include the following:

1. A coated pellet, with a zinc sulphide coating on a lead sulphide core, ensures that the pellet has a non-sticky outer surface of zince oxide during the roasting process.

2. Preliminary experiments on the oxidation at 900°-950° C. of pellets coated with zinc sulphide suggest that less lead sulphate is formed than in mixed zinc/lead sulphide pellets. This may be due to the lower "oxygen potential" of gas permeating to the inner core of lead sulphide through the outer layer of ZnS/ZnO.

3. By judiciously choosing the thickness of the ZnS coating in relation to the diameter of the PbS core it is possible to adjust the Zn/Pb ratio in a charge for feeding to a zinc/lead blast furnace.

The invention provides a composite pellet which is substantially spherical in shape and has a central core predominantly of lead sulphide and an outer shell predominantly of zinc sulphide.

DESCRIPTION OF THE PREFERRED EMBODIMENTS

The pelletizing of lead sulphide and coating of the lead sulphide core with zinc sulphide may be achieved by employing known apparatus, e.g. a disc or drum pelletizer, the material to be pelleted, i.e. first the lead sulphide and subsequently the zinc sulphide, being fed, in powder form, together with water, and preferably with a binder, onto respective rotating discs or drums whereon the constant rolling of the particles on the disc or drum surface leads to build up of substantially spherical pellets. It is desirable not to dry the lead sulphide core particles before coating them with zinc sulphide. Additions of binders, e.g. aqueous zinc sulphate solution or sulphite lye, may be made with the water fed to the disc or drum pelletizers. Addition of solid binders, e.g. bentonite or hydrated lime, may also be made. Fluxes may also be added, and calcium oxide or silica may be used for this purpose. The sulphide particles fed to the pelletizer are preferably predominantly −300 mesh B.S.S. (preferably at least 40% −300 mesh).

The invention will be further described with reference to the following illustrative Example.

Examples of pellets according to the invention are as follows:

(1) An inner core of PbS 4.0 mm in diameter surrounded by a layer of ZnS 1.5 mm thick, thus having an overall pellet diameter of 7.0 mm. Taking the density of PbS as 7.5 and that of ZnS as 4.1, the approximate weight ratio ZnS/PbS=2.4.

(2) An inner core of PbS 5.0 mm in diameter surrounded by a layer of ZnS 1.5 mm thick, thus having an overall pellet diameter of 8.0 mm. The approximate weight ratio ZnS/PbS=1.7.

(3) An inner core of PbS 3.0 mm in diameter surrounded by a layer of ZnS 1.0 mm thick, thus having an overall pellet diameter of 5.0 mm. The approximate weight ratio ZnS/PbS=2.0.

These pellets were formed by rolling lead sulphide concentrates (65%-300 mesh) onto a pelletizing disc with water (about 8% by weight) and bentonite (about 0.5% by weight) to give pellet cores of the stated diameter. These pellet cores were sieved to remove undersize and oversize cores and fed, without dyring, to a second disc pelletizer where they were coated with zinc sulphide concentrates using water and bentonite in the proportions set out above.

The coated pellets were then roasted in (a) air at 950° C., and/or (b) roaster gas containing 7% by volume $SO_2$ at 950° C.

After 40 minutes the residual sulphur in the pellets in case (a) was about 1% by weight and in case (b) less than 4% by weight but greater than 3% by weight.

In industrial practice the roasting is preferably achieved by using two fluidized beds in series, the first one being fed with roaster gas and the second one with pre-heated air with overflow of solids from the first bed to the second. Residence time in such fluidized beds is typically from 2 to 4 hours in each bed depending upon blowing rates and sizes of pellets.

The roasted pellets may be fed into a roll-press for briquetting, according to the method set out in British Patent Specification No. 1,302,864. Good densification may be achieved and hard substantially flaw-free briquettes may be obtained.

I claim:

1. A composite pellet which is substantially spherical in shape and has a central core predominantly of lead sulphide and an outer shell predominantly of zinc sulphide.

2. The composite pellet according to claim 1, wherein the predominantly lead sulphide core is from 2 to 6 mm in diameter and the predominantly zinc sulphide shell has a thickness of from 1 to 3 mm.

3. The composite pellet according to claim 1, wherein the weight ratio of zinc sulphide to lead sulphide therein is from 1.5:1 to 2.5:1.

* * * * *

UNITED STATES PATENT AND TRADEMARK OFFICE

CERTIFICATE OF CORRECTION

PATENT NO. : 4,274,878

DATED : June 23, 1981

INVENTOR(S) : James A. Charles

It is certified that error appears in the above—identified patent and that said Letters Patent is hereby corrected as shown below:

On the Title Page,
(73) Assignment Document
"Metallurgical Processes Limited;
I.S.C. Smelting, both of the Bahamas"
SHOULD BE -- METALLURGICAL PROCESSES LIMITED and
I. S. C. SMELTING LIMITED, a corp. of the
Bahamas --.

Signed and Sealed this

*Twelfth* Day of *January 1982*

[SEAL]

*Attest:*

GERALD J. MOSSINGHOFF

*Attesting Officer* *Commissioner of Patents and Trademarks*